US008336257B2

(12) United States Patent
McDonald et al.

(10) Patent No.: US 8,336,257 B2
(45) Date of Patent: Dec. 25, 2012

(54) TELESCOPING FLOOR SEAL FOR VERTICALLY DISPLACEABLE PARTITION

(75) Inventors: Mark McDonald, Beaconsfield (CA); Jack Zagorski, Saint Lazare (CA); Liang Kan Zheng, Montreal (CA)

(73) Assignee: Railquip Enterprises Inc., Baie d'Urfe, Quebec (CA)

( * ) Notice: Subject to any disclaimer, the term of this patent is extended or adjusted under 35 U.S.C. 154(b) by 116 days.

(21) Appl. No.: 12/893,119

(22) Filed: Sep. 29, 2010

(65) Prior Publication Data

US 2012/0011777 A1 Jan. 19, 2012

Related U.S. Application Data

(60) Provisional application No. 61/365,148, filed on Jul. 16, 2010.

(51) Int. Cl.
*E06B 7/21* (2006.01)

(52) U.S. Cl. ..... 49/306; 49/303

(58) Field of Classification Search ..... 49/197, 49/199, 303, 306, 316, 320, 321
See application file for complete search history.

(56) References Cited

U.S. PATENT DOCUMENTS 2,659,115 A * 11/1953 Anderson et al. ..... 49/277
3,086,261 A * 4/1963 Lapof ..... 49/316
3,374,821 A * 3/1968 White ..... 160/40
4,020,595 A * 5/1977 Duncan ..... 49/306
4,027,714 A * 6/1977 Dixon et al. ..... 160/84.08
4,277,920 A * 7/1981 Dixon ..... 52/64
4,406,088 A * 9/1983 Berndt, Jr. ..... 49/309
4,519,165 A * 5/1985 Cronenberg et al. ..... 49/307
4,703,586 A * 11/1987 Smith et al. ..... 49/307
4,805,345 A * 2/1989 Ohi ..... 49/308
5,062,464 A 11/1991 Peterson
5,339,881 A * 8/1994 Owens ..... 160/40
5,454,192 A * 10/1995 Adler et al. ..... 49/307
5,467,559 A * 11/1995 Owens ..... 49/321
5,471,791 A * 12/1995 Keller ..... 49/317
5,481,834 A * 1/1996 Kowalczyk et al. ..... 52/64
5,577,348 A * 11/1996 Keller ..... 49/317
6,082,047 A * 7/2000 Comaglio et al. ..... 49/308

(Continued)

OTHER PUBLICATIONS

Hufcor Premier Bi-Fold Door; Hufcor, Inc.; found at http://www.hufcorbifold.com/index.html; printed Oct. 26, 2009; Copyright 2008; 2 pages.

(Continued)

*Primary Examiner* — Katherine W Mitchell
*Assistant Examiner* — Justin Rephann
(74) *Attorney, Agent, or Firm* — Norton Rose Canada LLP

(57) ABSTRACT

A telescoping floor seal assembly comprising an attachment portion adapted to be mounted to a bottom edge of a vertically displaceable partition, and a displaceable sealing portion slideably mounted within the attachment portion for relative displacement therewith between a fully collapsed position and a fully extended position and described. The displaceable sealing portion has at least one longitudinal sealing edge member at a base thereof for contacting a floor when the vertical partition is displaced to a closed position. The attachment portion is substantially vertically displaceable with the vertically displaceable partition while the sealing edge member of the displaceable sealing portion remains in sealing contact with the floor within a predetermined displacement range of vertical movement of the vertical partition. The telescoping floor seal assembly thereby accommodates live load deflections of the vertically displaceable partition without compromising the seal formed between the floor and the telescoping floor seal.

11 Claims, 4 Drawing Sheets

U.S. PATENT DOCUMENTS

| | | | | |
|---|---|---|---|---|
| 6,112,466 | A * | 9/2000 | Smith et al. | 49/306 |
| 6,125,584 | A * | 10/2000 | Sanders | 49/312 |
| 6,167,937 | B1 * | 1/2001 | Williams | 160/40 |
| 6,267,169 | B1 | 7/2001 | McDonald | |
| 6,808,000 | B1 | 10/2004 | Peterson | |
| 7,156,142 | B2 | 1/2007 | Peterson | |
| 7,320,496 | B2 * | 1/2008 | Griffis et al. | 296/146.1 |
| 2004/0010973 | A1 * | 1/2004 | Lio et al. | 49/306 |
| 2007/0033875 | A1 * | 2/2007 | Griffis et al. | 49/308 |

OTHER PUBLICATIONS

Loschwand Products; Loschwand; found at http://www.loschwand.de/eng/products/Products00.html; printed Oct. 26, 2009; 1 page.

* cited by examiner

TELESCOPING FLOOR SEAL FOR VERTICALLY DISPLACEABLE PARTITION

CROSS-REFERENCE TO RELATED APPLICATIONS

The present application claims priority on U.S. provisional patent application No. 61/365,148 filed Jul. 16, 2010, the entire content of which is incorporated herein by reference.

TECHNICAL FIELD

The application relates generally to movable wall partition systems used to divide areas of a building, and more particularly to a floor seal for such a movable wall partition.

BACKGROUND

Movable partition walls are often used to divide interior building spaces into smaller spaces. Examples of such use includes convention halls, large rooms in hotels, school class rooms and gymnasia, work areas in factories, etc. to name a few! Such walls may be formed merely from fabric or other like material, and take the form of curtains which may be drawn closed or opened. Other, more durable types of movable wall partitions are made of rigid material, extending from floor to ceiling and having heat and/or sound insulating materials between a rigid wall-forming exterior. Typically, such wall partition systems of the rigid-type move horizontally. Such types of movable walls require storage space (in plan) to accommodate the wall panels when not in use. The wall panels may be very heavy and impose differing loads on the support structure, which may be ceiling or roof mounted, as the panels are moved, with the loads increasing as the panels are retracted to their storage positions.

As a result of the foregoing, vertically collapsible partition systems have been developed. Many such systems incorporate a pantograph configuration similar to that of baby gates, in which a series of beams or segments are pivotally linked together to provide a series of similar diamond-shaped structures along the length of the frame and transverse to the vertical plane to be occupied by the extended structure. The structures are downwardly extended by gravity and as a consequence may not fully extend to provide a vertically planar surface. Additionally, there may be gaps between the bottom of the fully extended structure and the floor.

Accordingly, there is a need for an improved seal structure between a bottom of such vertically collapsible partitions and the floor in order to provide an improved seal therebetween.

SUMMARY

In accordance with an aspect of the present invention, there is provided a telescoping floor seal assembly comprising an attachment portion adapted to be mounted to a bottom edge of a vertically displaceable partition, and a displaceable sealing portion slideably mounted within the attachment portion for relative displacement therewith between a fully collapsed position and a fully extended position. The displaceable sealing portion has at least one longitudinal sealing edge member at a base thereof for contacting a floor when the vertical partition is displaced to a closed position. The attachment portion is substantially vertically displaceable with the vertically displaceable partition while the sealing edge member of the displaceable sealing portion remains in sealing contact with the floor within a predetermined displacement range of vertical movement of the vertical partition. The telescoping floor seal assembly thereby accommodates live load deflections of the vertically displaceable partition without compromising the seal formed between the floor and the telescoping floor seal.

BRIEF DESCRIPTION OF DRAWINGS

The embodiments of the present disclosure will now be described by reference to the following figures, in which identical reference numerals in different figures indicate identical elements, and in which.

DETAILED DESCRIPTION

Figure 1:
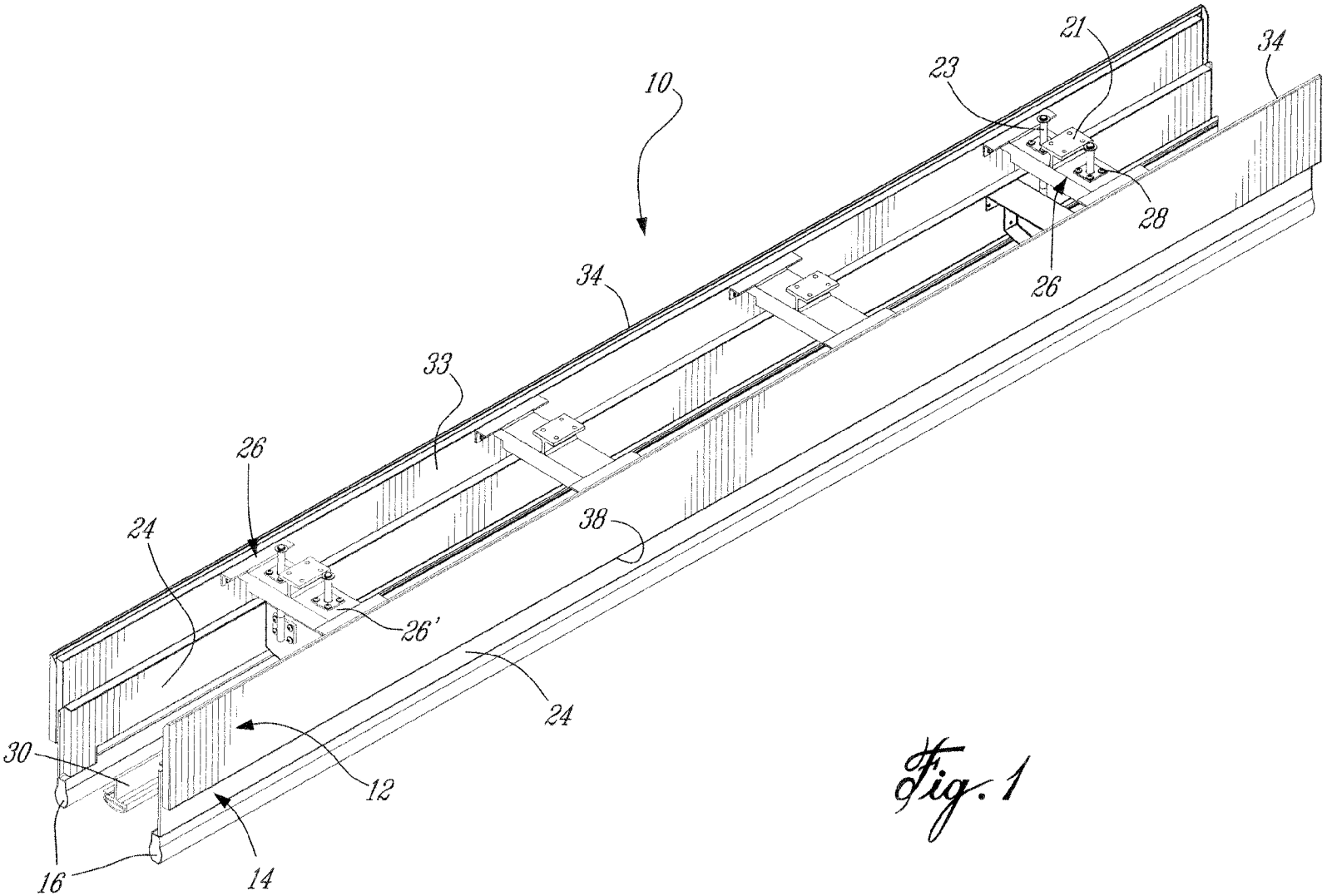
FIG. 1 is an isometric view of a telescoping floor seal in accordance with an embodiment of the present disclosure.

Referring to FIGS. 1-5, there is shown a telescoping floor seal assembly 10 constructed in accordance with one particular embodiment of the present invention. The telescoping floor seal assembly 10 is adapted to be mounted to the bottom edge 52 of a lowermost panel 54 of a vertically displaceable partition 50 (see FIG. 5). The vertically displaceable panel may be of any suitable type, however in one particular embodiment includes the vertically displaceable partition or barrier described in U.S. patent application Ser. No. 12/512,935 filed Jul. 30, 2009, the entire contents of which is incorporated herein by reference.

The telescoping floor seal assembly 10 comprises generally an attachment portion 12 adapted to be mounted to the lowermost panel 54 of the vertically displaceable partition 50, and a displaceable sealing portion 14 slideably mounted within the attachment portion 12 for relative displacement therebetween. The displaceable sealing portion 14 is slideably moveable, in a substantially vertical travel direction, within the attachment portion 12 between a fully collapsed position (see FIG. 3) and a fully extended position (see FIG. 4). The displaceable sealing portion 14 includes at least one elongated sealing lower edge member 16 at a base thereof for contacting a floor surface 31 when the vertical partition is disposed in a closed position. In the depicted embodiment, the displaceable sealing portion 14 includes two elongated sealing edge members 16, disposed substantially parallel to each other and extending along the complete width of the base of the partition. The sealing edge members 16 thereby form a tight seal with the floor surface 31 against which they abut. The seal provided by the sealing edge members 16 may include a complete acoustic seal, such as to form a barrier which substantially prevents unwanted noise to be transmitted from one side of the partition 50 to the other. The sealing edge members 16 may also provide thermal sealing, such that the rooms on either side of the partition 50 may be maintained at different ambient temperatures.

The displaceable sealing portion 14 and the attachment portion 12 of the telescoping floor seal assembly 10 accordingly permit relative displacement therebetween, which allows the telescoping floor seal assembly 10 to accommodate live load deflections of the vertically displaceable partition 50 to which the telescoping floor seal assembly 10 is mounted. Such live load deflections may be caused, for example, by deflections in roof structures to which the partition is mounted, which may result from snow loads, etc., that cause vertical movement of the entire partition wall. Regardless of this vertical movement of the partition wall, the telescoping floor seal assembly 10 maintains a secure seal (acoustic, thermal and/or other) between the base of the partition, herein the lowermost panel 54, and the floor surface 31.

Although various ranges of vertical displacement are possible, in at least one embodiment the telescoping floor seal assembly 10 can accommodate a substantially vertical travel of 1 to 15 inches of the partition wall panels without breaking the seal with the floor, although in a more particular embodiment approximately 2 to 4 inches of travel is permitted. In other words, the displaceable sealing portion 14 and the attachment portion 12 are displaceable relative to each other in a predetermined range which may be a distance of approximate 2-4 inches, 1-15 inches, or otherwise as needed.

Figure 2:
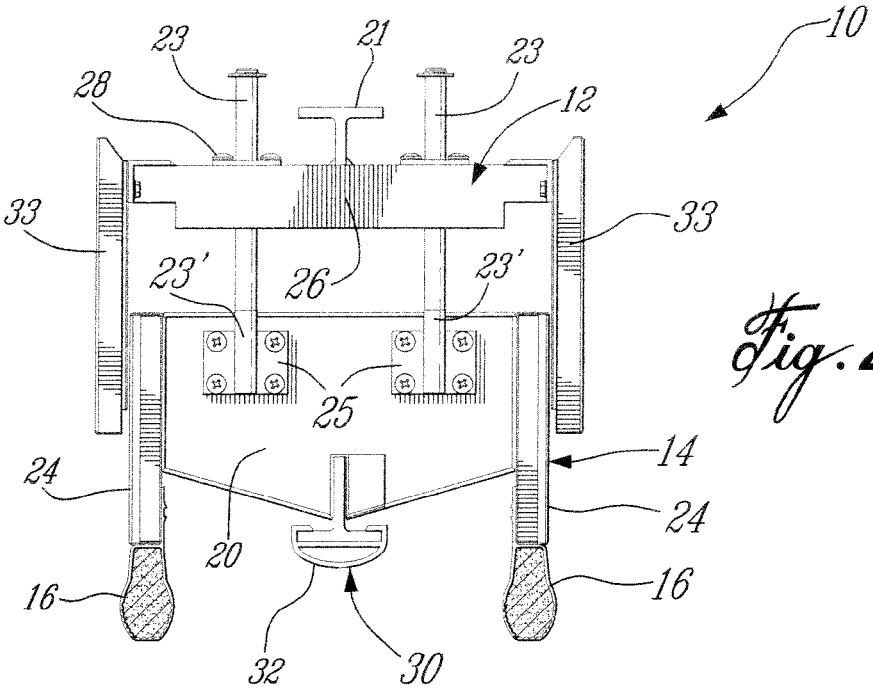
FIG. 2 is a cross-sectional view of the telescoping floor seal of FIG. 1, showing the displaceable sealing portion thereof in a midpoint position.
Figure 3:
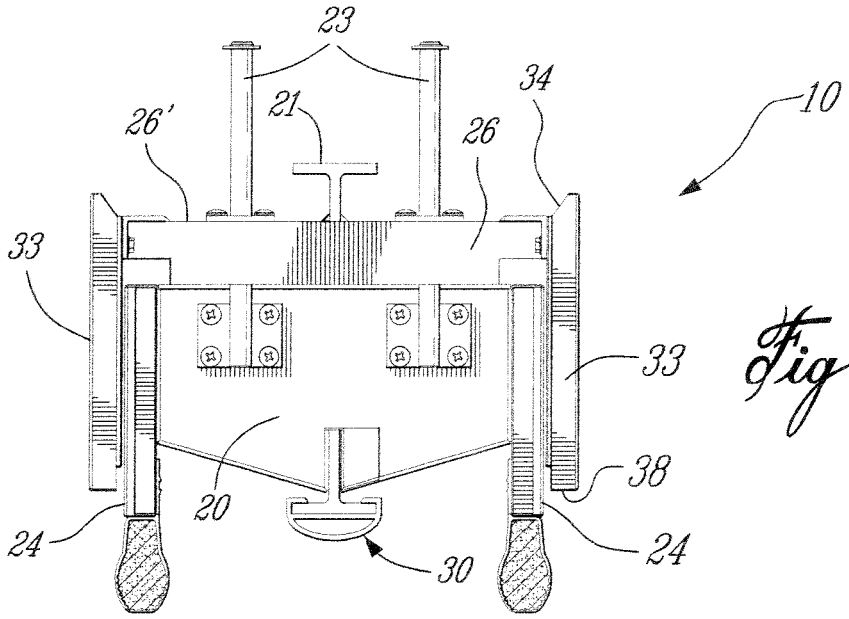
FIG. 3 is a cross-sectional view of the telescoping floor seal of FIG. 1, showing the displaceable sealing portion thereof in a fully compressed position.
Figure 4:
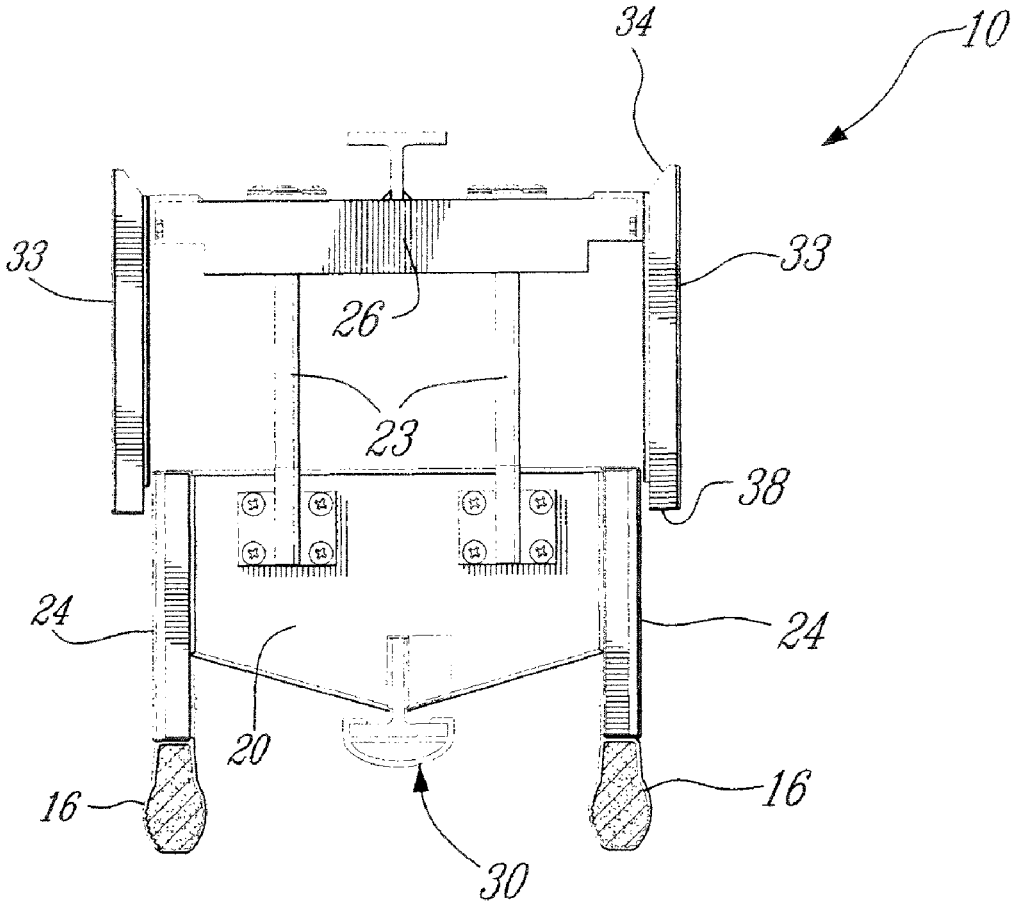
FIG. 4 is a cross-sectional view of the telescoping floor seal of FIG. 1, showing the displaceable sealing portion thereof in a fully extended position.
Figure 5:
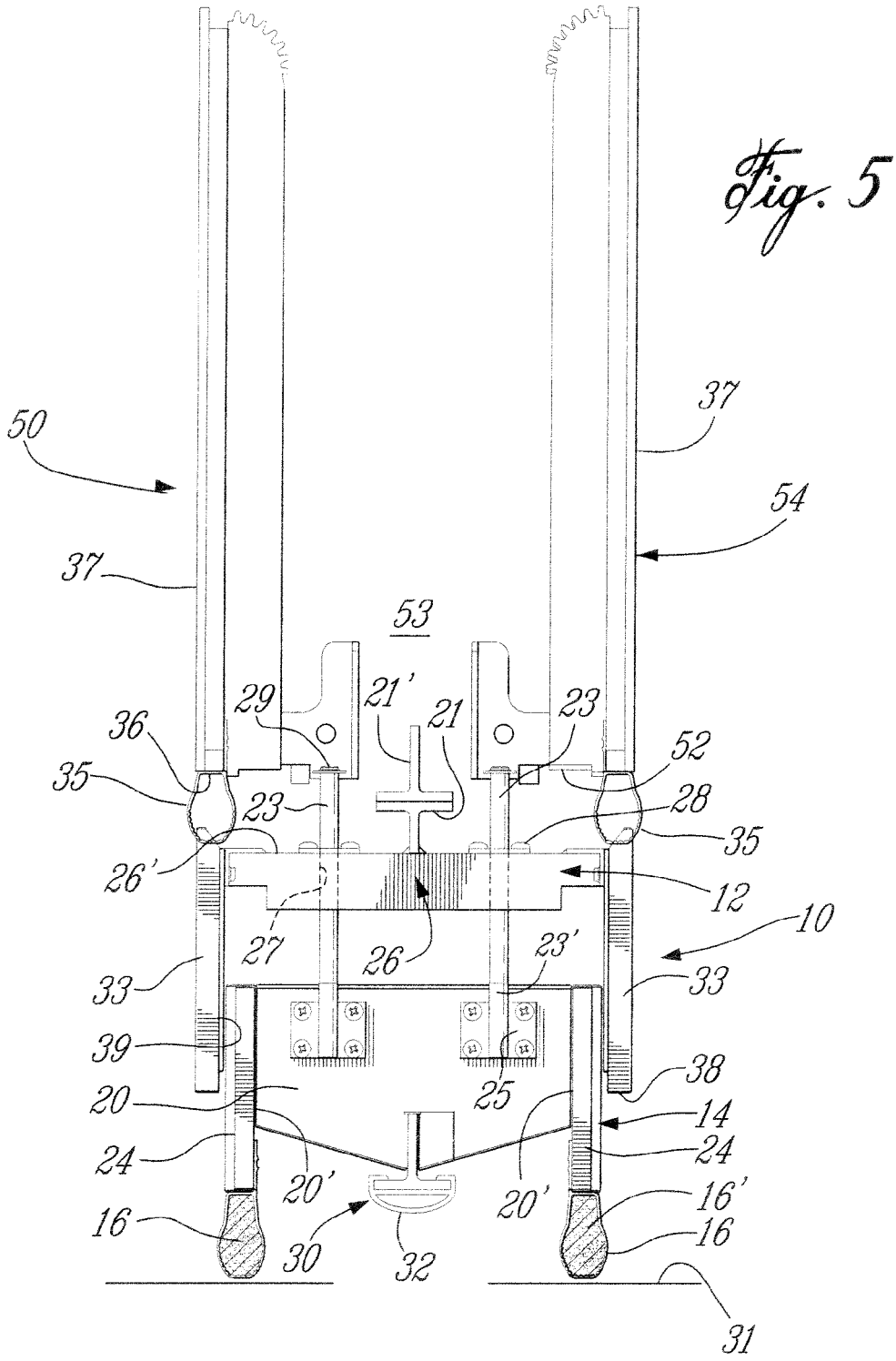
FIG. 5 is a cross-sectional view of the telescoping floor seal of FIG. 1, shown mounted to the bottom of a vertically displaceable partition.

The displaceable sealing portion 14 and the attachment portion 12 of the telescoping floor seal assembly 10 may slide relative to each other in a number of different manners, however in the presently depicted embodiment the displaceable sealing portion 14 fits within (i.e. telescopes into) the surrounding attachment portion 12, as seen in FIGS. 2-4. The attachment portion 12 thereby remains fixed to the bottom edge of the lowermost panel 54 of the vertically displaceable partition 50 such that it is substantially vertically displaceable as the partition wall moves, while the sealing edge member 16 of the displaceable sealing portion 14 remains in sealing contact with the floor, due to the relative displacement between the displaceable sealing portion 14 and the attachment portion 12. Thus, regardless of vertical movements of the partition wall, the telescoping floor seal assembly 10 accommodates such deflections of the vertically displaceable partition without compromising the seal, acoustic and/or otherwise, formed between the floor and the telescoping floor seal.

As shown in the drawings, and particularly in FIG. 1, attachment portion 12 comprises two or more spaced-apart transverse support brackets 26 having attachment means in the form of an attachment plate 21 for securing to an attachment member 21' fixed to the bottom edge, 52 of the displaceable partition 50. As hereinshown, the bottom edge 52 is a hollow bottom edge having a space 53 in a lower portion thereof to accommodate the displacement of telescopic interconnecting rods 23 displaceably secured to each support bracket 26.

The displaceable sealing portion 14 is hereinshown as comprising two vertically displaceable elongated sealing walls 24 each secured to a respective one of opposed side edges 20' of the transverse support wall 20. The two telescopic interconnecting rods 23 are transversely aligned and immovably secured at a lower end 23' thereof to attachment brackets 25 secured to the transverse support wall 20. These telescopic rods 23 extend through transversely aligned through bores 27 in the transverse support bracket 26 which constitutes the attachment portion 12. The telescopic rods also protrude through guide bushings 28 on the top wall 26' of the support bracket 26. A transverse formation or bushing 29 is provided at the free ends of the telescopic rods to limit outward extension of the interconnecting rods and accordingly the sealing walls 24, as shown in FIG. 4.

Although there are two displaceable elongated sealing walls 24 hereinshown, it is conceivable that a single sealing portion 14 may be secured to the transverse support bracket 20 and such sealing wall may be disposed closer to the central portion of the telescoping floor seal assembly. Further, the single sealing wall could also be made wider to provide more sound damping.

As shown in the drawings, the transverse support wall 20 is further provided with a pneumatic sensor assembly 30 immovably secured thereto at a central projecting lower portion thereof. The sensor assembly 30 comprises a bladder 32 closed at both ends to form the bladder of a pneumatic sensor assembly. When the bladder comes in contact with an obstruction it compresses and the resulting increase in internal air pressure trips a pneumatic switch, which in turn cuts power to the hoisting motor (not shown) and stops the downward motion of the partition, almost instantaneously. The sensor assembly 30 extends the entire length of the floor seal assembly.

As also shown in FIG. 1, there is a plurality of these transverse support brackets and a pair of elongated face plates 33 are secured thereto. The elongated face plates 33 are narrow, rectangular face plates. Each face plate 33 has a straight top edge 34 which is configured, as shown in FIGS. 2 to 5, for compressible engagement with a deformable elongated seal 35 secured along a lower edge 36 of the spaced opposed outer walls 37 of the lowermost panel 54 of the displaceable partition 50.

The face plates 33 also have a straight bottom edge 38 terminating in a common transverse plane disposed parallel and spaced downwardly from the lower edges 36 of the lowermost panel 54. The vertically displaceable elongated sealing walls 24 are disposed in close spaced relationship of a rear surface 39 of a respective one of the elongated face plates 33.

The deformable seal members 16 may be hollow deformable wall members formed of rubber material or other suitable deformable material. They may also be formed as solid deformable seals having a compressible and deformable material 16' throughout. As hereinshown, these deformable seal members 16 are in the shape of a bulb seal.

It is within the ambit of the present invention to cover any other obvious modifications provided such modifications fall within the scope of the appended claims.

The invention claimed is:

1. A telescoping floor seal assembly comprising an attachment portion adapted to be mounted to a bottom edge of a vertically displaceable partition, and a displaceable sealing portion slideably mounted within the attachment portion for relative displacement therewith between a fully collapsed position and a fully extended position, the displaceable sealing portion having at least one longitudinal sealing edge member at a base thereof for contacting a floor when the vertical partition is displaced to a closed position, the attachment portion being substantially vertically displaceable with the vertically displaceable partition while the sealing edge member of the displaceable sealing portion remains in sealing contact with the floor within a predetermined displacement range of vertical movement of the vertical partition, the telescoping floor seal assembly thereby accommodating live load deflections of the vertically displaceable partition without compromising the seal formed between the floor and the telescoping floor seal, wherein said attachment portion comprises two or more spaced-apart transverse support brackets having attachment means for securement to said bottom edge of said vertically displaceable partition, said displaceable sealing portion comprising at least one vertically displaceable elongated sealing wall secured to said transverse support brackets for vertical guided displacement therewith, said longitudinal sealing edge member being a deformable seal member secured to said base at a lower end of said vertically displaceable sealing wall, and wherein said bottom edge of said vertically displaceable partition is an elongated substantially rectangular hollow bottom edge formed between spaced opposed outer walls of said vertically displaceable partition, there being two of said vertically displaceable elongated sealing walls each secured to a respective one of opposed side edges of a transverse support wall, at least one telescopic interconnecting rod immovably secured to said transverse support wall and extending through said transverse support bracket in captive sliding engagement therewith.

2. A telescoping floor seal assembly as claimed in claim 1 wherein there are two of said telescoping interconnecting rods spaced-apart in transverse alignment and extending through a respective guide bushing secured to said transverse support bracket, and arresting means to limit outward extension of each said telescoping interconnecting rods.

3. A telescoping floor seal assembly as claimed in claim 2 wherein said arresting means is constituted by a transverse formation at a free end of each said telescoping interconnecting rods for abutment with a top wall of said respective guide bushing about a guiding through bore thereof.

4. A telescoping floor seal assembly as claimed in claim 1 wherein said attachment means is an attachment plate secured to and spaced above each said transverse support brackets, there being a plurality of said transverse support brackets spaced along said attachment portion.

5. A telescoping floor seal assembly as claimed in claim 1 wherein opposed side edges of said transverse support bracket are secured to a pair of face plates, each said face plate having a straight bottom edge terminating in a common transverse plane disposed parallel and spaced downwardly from said rectangular hollow bottom edge, said vertically displaceable elongated sealing walls being disposed in closely spaced relationship of a rear surface of a respective one of said elongated face plates.

6. A telescoping floor seal assembly as claimed in claim 5 wherein said face plates are elongated narrow rectangular face plates, each face plate having a straight top edge configured for compressible engagement with a deformable elongated seal secured along a lower edge of said spaced opposed outer walls of said vertically displaceable partition.

7. A telescoping floor seal assembly as claimed in claim 1 wherein said deformable seal member is a hollow deformable seal member.

8. A telescoping floor seal assembly as claimed in claim 1 wherein said deformable seal member is a solid deformable seal.

9. A telescoping floor seal assembly as claimed in claim 1, wherein said predetermined displacement range is less than about 15 inches.

10. A telescoping floor seal assembly as claimed in claim 9 wherein said predetermined displacement range is between 1 inch and 15 inches.

11. A telescoping floor seal assembly as claimed in claim 10 wherein said predetermined displacement range is between 2 inches and 4 inches.

* * * * *